US005131304A

United States Patent [19]

Paavola

[11] Patent Number: 5,131,304

[45] Date of Patent: Jul. 21, 1992

[54] UPPER BLADE HOLDER

[75] Inventor: Antti Paavola, Helsinki, Finland

[73] Assignee: Valmet Paper Machinery Inc., Helsinki, Finland

[21] Appl. No.: 514,586

[22] Filed: Apr. 26, 1990

Related U.S. Application Data

[63] Continuation-in-part of Ser. No. 316,408, Feb. 27, 1989, abandoned.

[30] Foreign Application Priority Data

Mar. 14, 1988 [FI] Finland ..... 881195

[51] Int. Cl.[5] ..... B23D 19/04; B26D 1/24

[52] U.S. Cl. ..... 83/478; 83/482; 83/496; 83/504; 83/698

[58] Field of Search ..... 83/478, 482, 481, 496, 83/499, 502, 503, 508.2, 700, 698, 504

[56] References Cited

U.S. PATENT DOCUMENTS

| | | | |
|---|---|---|---|
| 1,482,437 | 2/1924 | Koegel et al. | 83/496 |
| 1,754,969 | 4/1930 | Spoor | 83/482 |
| 2,802,528 | 8/1957 | Mastriani | 83/482 |
| 3,143,024 | 8/1964 | Markowski | 83/497 |
| 3,186,282 | 6/1965 | Waterhouse | 83/497 |
| 4,041,823 | 8/1977 | Ashbrook | 83/478 |
| 4,257,299 | 3/1981 | Aykut | 83/499 X |
| 4,434,695 | 3/1984 | Wingen | 83/502 X |
| 4,438,673 | 3/1984 | Noffke et al. | 83/502 |

FOREIGN PATENT DOCUMENTS

| | | | |
|---|---|---|---|
| 697108 | 9/1940 | Fed. Rep. of Germany | 83/502 |
| 15234 | of 1888 | United Kingdom | 83/503 |

*Primary Examiner*—Frank T. Yost
*Assistant Examiner*—Rinaldi Rada
*Attorney, Agent, or Firm*—Dellett, Smith-Hill and Bedell

[57] ABSTRACT

Upper blade holder intended for shear cutting of materials that run in a plane by means of a revolving pair of blades, wherein the toe-in angle of the upper blade can be set by means of a control prism. The upper blade holder comprises an upper blade journalling supported from both sides of the blade, which said journalling can be replaced without tools. The upper blade holder further comprises a protective cover of the upper blade, which said cover can be replaced without tools. This blade cover, together with the frame of the upper blade holder, encloses the upper blade and the lowering arms for the upper blade journalling. Moreover, the upper blade journalling comprises an actuator, by means of which the blade is displaced to the cutting position.

19 Claims, 4 Drawing Sheets

UPPER BLADE HOLDER

CROSS-REFERENCE TO RELATED APPLICATION

This is a continuation-in-part of copending patent application Ser. No. 7/316,048 filed Feb. 27, 1989, now abandoned.

BACKGROUND OF THE INVENTION

This invention relates to an upper blade holder for a slitter comprising upper and lower revolving blades in shearing relationship.

A slitter comprising upper and lower revolving blades in shearing relationship is employed, for example, for slitting various material webs, such as paper and board webs, foils, magnetic tapes, etc. The upper blade and the lower blade are placed so as to overlap each other partially. As a rule, in a slitter, it is possible to adjust the degree of overlapping of the blades and the force that presses the blades together as well as the toe-in angle between the blades.

In a known slitter, in which a pneumatic cylinder is used for lowering the upper blade into engagement into the lower blade, various problems and drawbacks have occurred in the upper blade holder. For example, the operation of the pneumatic cylinder has not always been satisfactory during its operating stroke. Also, when the web to be slit is fed to the slitter in a horizontal plane, the operation of the mechanism for adjusting the overlapping of the upper and lower blades has been to some extent dependent on the position of the blades. The mounting and the protection of the blade and the blade support in the known slitter also leave room for improvement.

U.S. Pat. No. 3,956,957 discloses a device for slitting webs, wherein the upper and lower blades can be engaged and disengaged both in the radial direction and in the axial direction by use of a single handle. The device in accordance with this U.S. patent does not suggest a solution for elimination of the problems mentioned above.

SUMMARY OF THE INVENTION

In accordance with the present invention, an upper blade holder, for receiving an upper blade for use in combination with a lower blade for shear cutting of materials, comprises an upper blade support including shaft means having two opposite ends and defining a blade-receiving location between the two opposite ends, and means for supporting the shaft means at its two opposite ends, the means for supporting the shaft means including locating means for setting the toe-in angle of the upper blade by engaging the shaft means.

In the preferred embodiment of the invention, the stability of the upper blade support is improved because in the cutting position the upper blade support is supported at both sides of the blade. When the overlapping is adjusted, the frame of the upper blade holder is supported well irrespective of the position in which the upper blade holder is placed in the slitter.

The setting of the toe-in angle is simple, and the toe-in angle can be determined in consideration of the material to be cut.

The blade force can be set specifically for each blade.

Replacement of the upper blade can be carried out rapidly and easily, because no tools are required for the opening of the quick-release coupling of the blade support.

Grinding of the upper blade in order to sharpen it is possible without detaching the blade from its support, which improves the accuracy of rotation of the upper blade, because axial and radial swinging of the blade are minimized.

The working safety is improved, because the upper blade and the means for lowering the upper blade support are fully protected.

Only one pneumatic hose passes to the upper blade holder.

The sealing of the upper blade support against dust is efficient.

BRIEF DESCRIPTION OF THE DRAWINGS

In the following, the invention will be described in detail with reference to the figures in the accompanying drawing, wherein FIG. 3 is a sectional view taken on the line 3—3 of FIG. 1A.

Figures 1A, 1B:
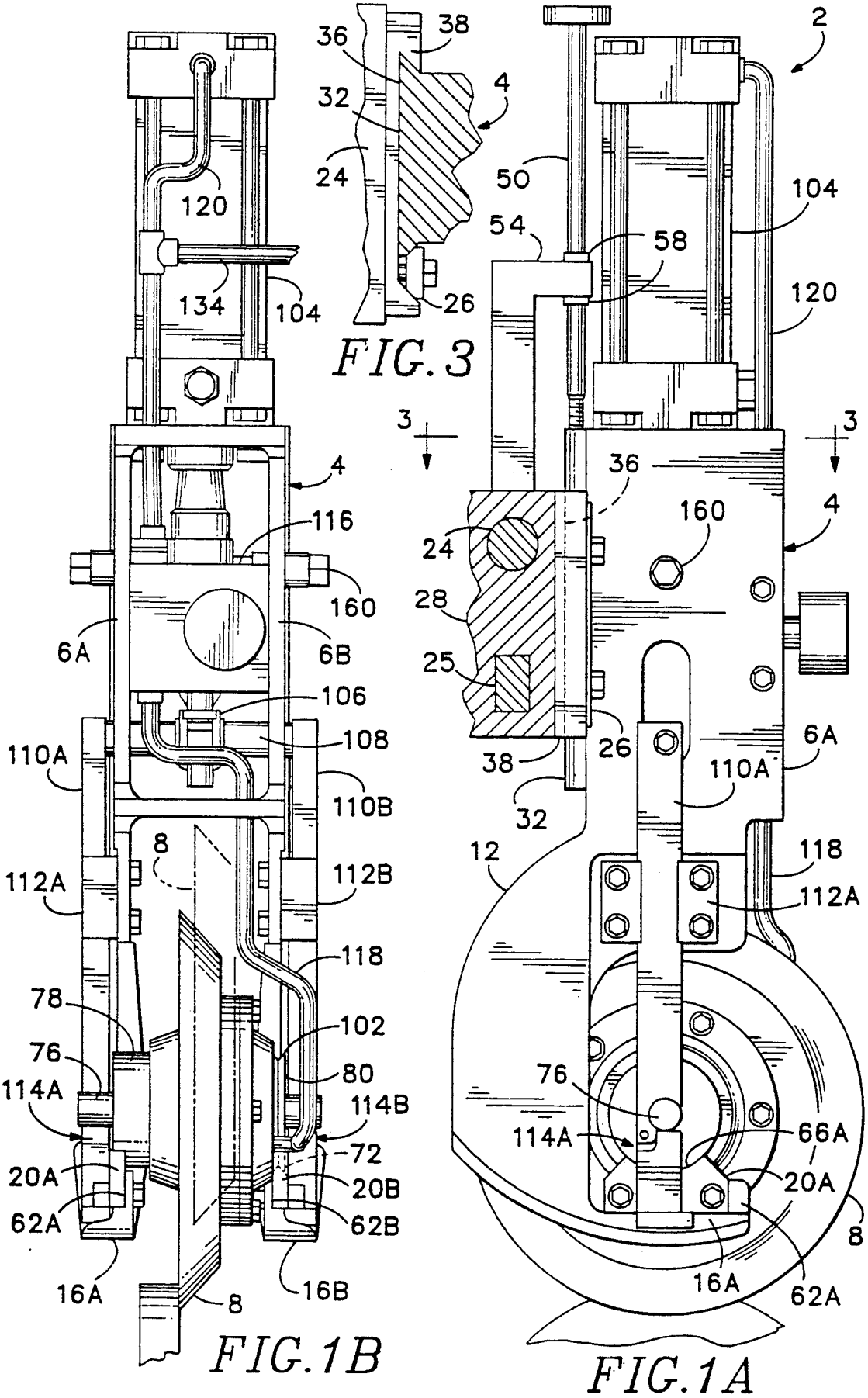
FIG. 1A is a side elevation of the upper blade holder, shown with the blade cover removed.
FIG. 1B is a rear elevation of the upper blade holder.

In the drawings, suffixes A and B are applied to reference numerals to designate corresponding components on opposite sides of the upper blade holder.

DETAILED DESCRIPTION

The upper blade holder 2 shown in FIGS. 1A and 1B consists of a holder body 4 having two opposite sides 6A, 6B between which a rotary blade 8 is supported. Body 4, which is made of aluminum or some other metal, is mounted to transverse guide rails 24, 25 by means of a slitter carriage 28 that is movable longitudinally of the rails on bearings (not shown) to adjust the position of the upper blade to achieve the desired width of strip. Body 4 is mounted to carriage 28 by means of a releasable dovetail coupling. A dovetail formation 32 projects from body 4 into a groove 36 formed in a plate 38 attached to carriage 28. A wedge rod 26 that is attached to plate 38 by means of lock screws can be loosened to allow vertical movement of body 4 relative to carriage 28 under control of an adjustment screw 50. Screw 50 is in threaded engagement with body 4, and its shank extends through a housing 54 that is attached to carriage 28. Screw 50 is supported in housing 54 by bearings (not shown) and is held against axial movement relative to housing 54 by snap rings 58. By turning screw 50 when the wedge rod has been loosened, body 4 can be raised or lowered so as to adjust the overlapping of the blades. When a desired overlapping of the upper blade with the lower blade has been achieved, the lock screws are tightened and the wedge rod is forced against plate 38 so that body 4 is held securely against vertical movement relative to carriage 28.

Body 4 includes a guard portion 12 which partly surrounds the upper blade. Two blade support structures 16A, 16B extend from guard portion 12 in the upstream direction with respect to the direction of feed of the web. Blade locating blocks 20A, 20B are attached to structures 16A, 16B respectively. The blade locating blocks are bolted to respective mutually parallel vertical surfaces 62A, 62B of structures 16A, 16B. Each blade locating block 20 is generally triangular in form, except that it has a recess 66 at its upper apex for receiving an end of an upper blade support 74. The surface of recess 66A in block 20A is part cylindrical, and the axis of curvature of that surface is horizontal and extends at a predetermined angle to surfaces 62. This angle is determined by grinding the surface of block 20A that engages surface 62A. The surface of recess 66B is defined by two segments of oppositely tapering coaxial cones, so that a triangular-section ridge 72 is defined. The center of curvature of ridge 72 lies on the axis of curvature of the surface of recess 66A and the plane of ridge 72 is perpendicular to the axis of curvature of the surface of recess 66A. The orientation of the plane of ridge 72 is determined by grinding the surface of block 20B that engages surface 62B.

Figure 4:
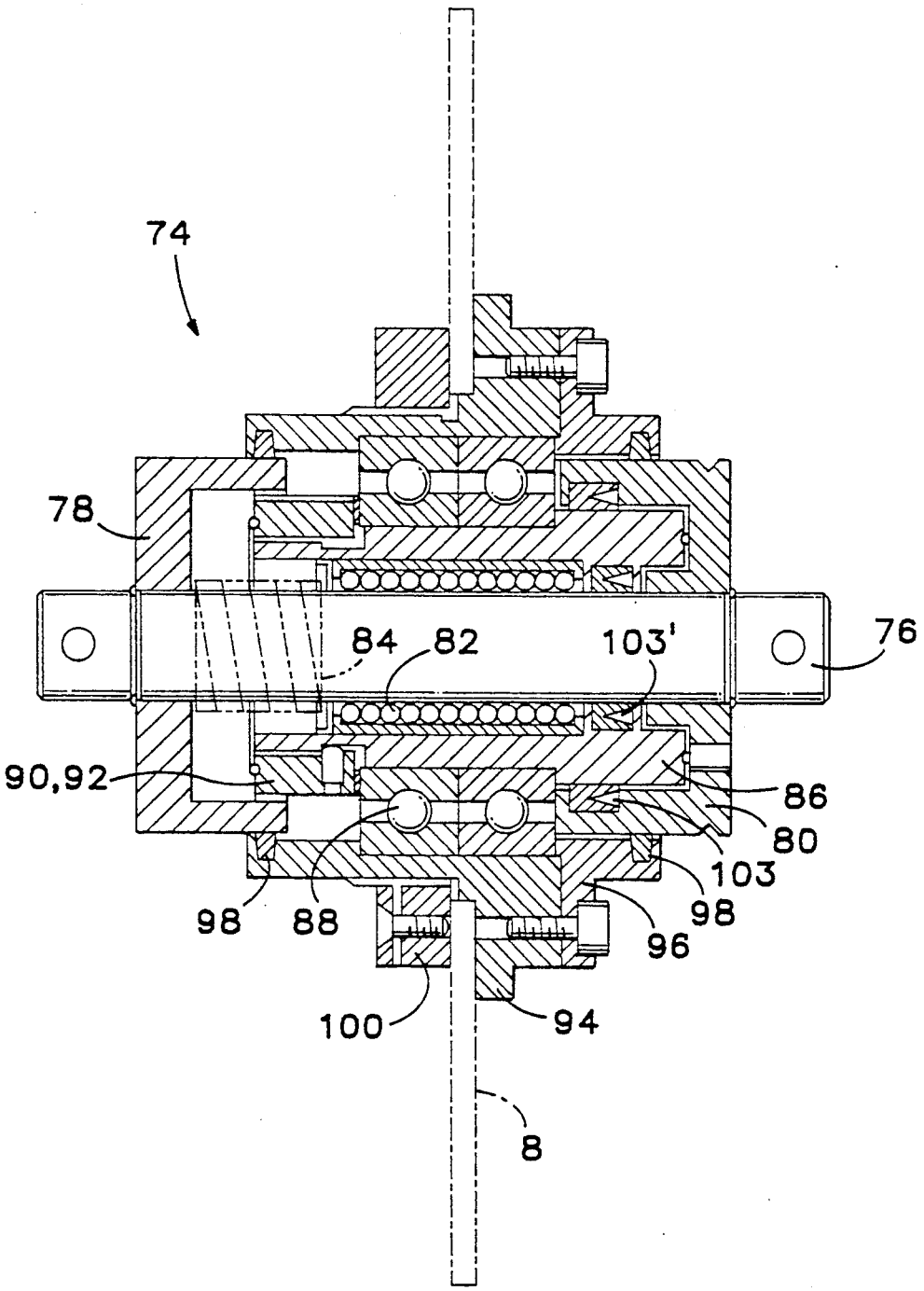
FIG. 4 is a sectional view of the support for the upper blade.

The upper blade support 74 is shown in FIG. 4 and comprises a shaft 76 on which two end covers 78, 80 are retained. A piston 86 is mounted on the shaft 76 by means of a linear bearing 82, which allows the piston 86 to slide longitudinally of the shaft 76. A return spring 84 urges the piston 86 to the right of FIG. 4, towards the end cover 80. A pair of precision ball bearings 88 and their retainers 90, 92 are mounted on the piston 86, and an upper blade hub 94 is mounted on the bearings 88 by means of a flange 96. The upper blade 8 is clamped against the upper blade hub 94 by an upper blade fastener 100. The hub 94 and the flange 96 receive respective dust seals 98, which slide over the end covers 78, 80. The end cover 78 is cylindrical and the end cover 80 has a peripheral recess 102 that is triangular in section. As shown in FIG. 4, the piston 86 acts as a shaft for the ball bearings 88, which allow rotation of the hub 94 and the upper blade 8 that is clamped thereto about the central axis of shaft 76. The linear bearing 82 allows the piston 86 to move longitudinally of the shaft 76, and when the piston so moves the upper blade hub 94 and the upper blade 8 also move longitudinally of the shaft 76. Compressed air can be supplied to the pneumatic cylinder formed by end cover 80 and shaft 76 to displace the piston 86 to the left of FIG. 4. The piston 86 is returned by the force of the spring 84 when the pneumatic cylinder is vented. A pneumatic seal 103 held by the end cover 80 runs against the piston 86 and a pneumatic seal 103' held by the piston 86 runs against the shaft 76.

The upper blade holder also comprises a pneumatic cylinder 104 secured by tie bolts to holder body 4. The piston rod of cylinder 104 is connected through a universal joint 106 to a cross bar 108, having lowering arms 110A, 110B attached to its opposite respective ends Lowering arms 110 extend slidingly through linear guides 112 and are connected at their lower ends to opposite respective ends of shaft 76 by means of quick-release connectors 114*a*, 114*b*. Cylinder 104 is a single-acting spring-retracted cylinder When compressed air is supplied to the cylinder, the piston rod is forced down and lowering arms 110 force end covers 78, 80 into the recesses of blade-locating blocks 20A, 20B respectively. The central axis of shaft 76 then coincides with the axis of curvature of the surface of recess 66A. Thus, the orientation of the axis of curvature of the surface of recess 66A establishes the toe-in angle of the upper blade. Engagement of ridge 72 in recess 102 of end cover 80 fixes upper blade support 74 against axial movement. The compression force applied by cylinder 104 is transferred from the shaft 76 of the support 74 to the end covers 78, 80. After the upper blade support has been lowered, the upper blade 8 is axially shifted into contact with the lower blade by means of compressed air supplied to a pneumatic cylinder formed by end cover 80 and shaft 76.

When cylinder 104 is vented, the retraction spring (not shown) urges the piston rod upwards, raising the upper blade to the home position shown in dashed lines in FIG. 1B. The home position is fixed relative to the holder body. The work position of the blade, shown in solid lines in FIG. 1B, is determined by the lower blade.

The upper blade holder also comprises a valve package 116. The valve package is connected through hoses 120 and 134 and a solenoid valve (not shown) to a source of compressed air. The hose 120 is connected through a quick-release pneumatic connector to cylinder 104. The valve package is also connected through a hose 118 and a quick-release pneumatic connector to the upper blade support. The valve package includes a pressure switch that allows compressed air to flow to upper blade support 74 only when the pressure in hose 120 exceeds a predetermined threshold level. This ensures that the upper blade support is engaged with locating blocks 20 before the cylinder formed by end cover 80 and shaft 76 is pressurized and upper blade 84 shifted into contact with the lower blade.

Figure 5:
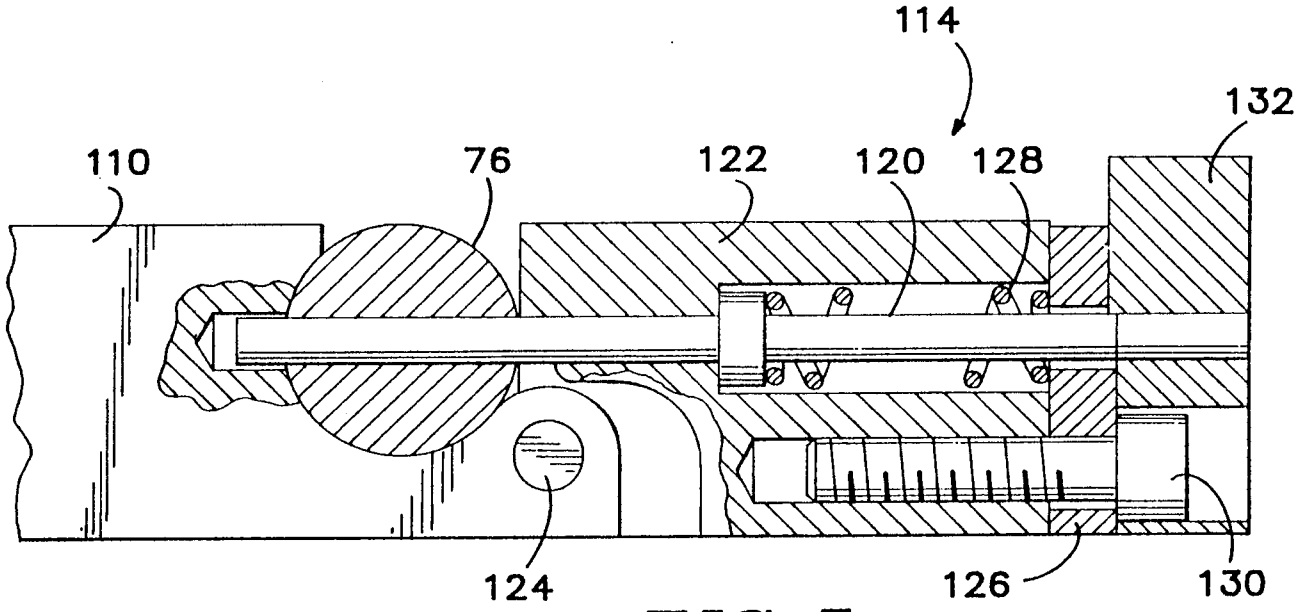
FIG. 5 shows a quick-release coupling for the upper blade support.

Referring to FIG. 5, quick-release connector 114 comprises a pin 120 that extends slidingly within a bore in a lock body 122. Lock body 122 is connected to lowering arm 110 by means of a pivot pin 124. Pin 120 is held captive in lock body 122 by means of a holder 126, and is biased by a spring 128 to project from lock body 122. In the position shown in FIG. 5, pin 120 extends through a hole in the shaft 76 of upper blade support 74 and into the lowering arm 110. Pin 120 prevents rotation of shaft 76. Support 74 applies only shear forces to the spring-loaded pin, so that it cannot be retracted except by application of an external force. Holder 126, against which spring 128 bears, is connected to lock body 122 by means of a screw 130. The quick-release connectors 114 can be opened by means of a knob 132 on the spring-loaded pin 120.

Figure 2B:
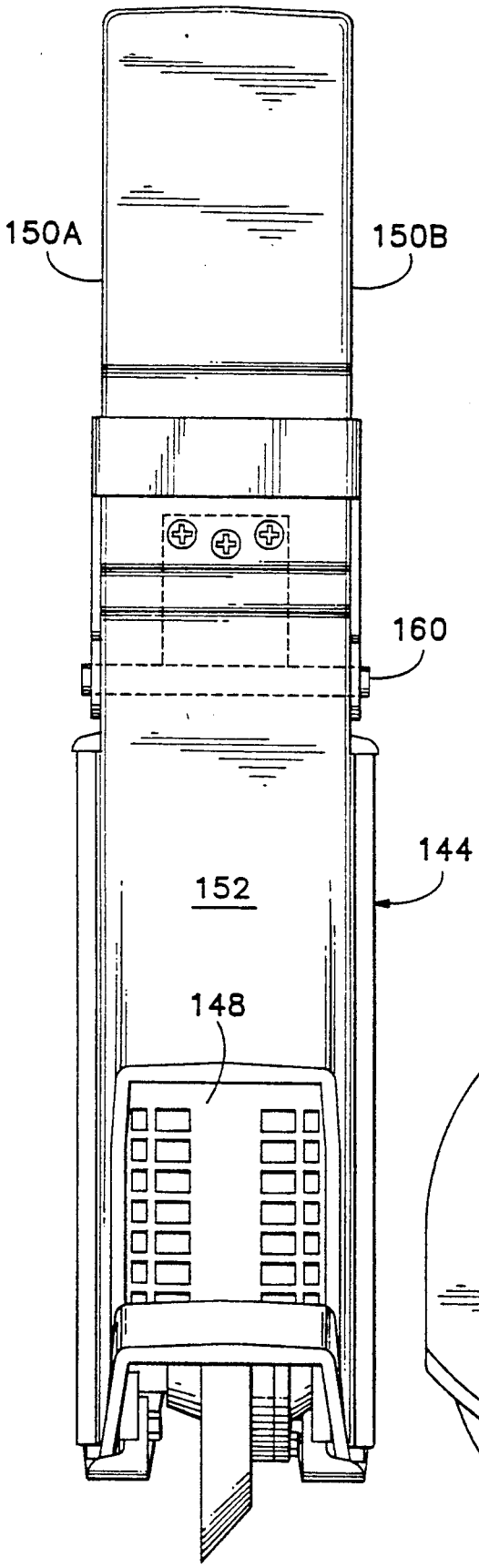
FIGS. 2A and 2B are views similar to FIGS. 1A and 1B with the blade cover attached.
Figure 2A:
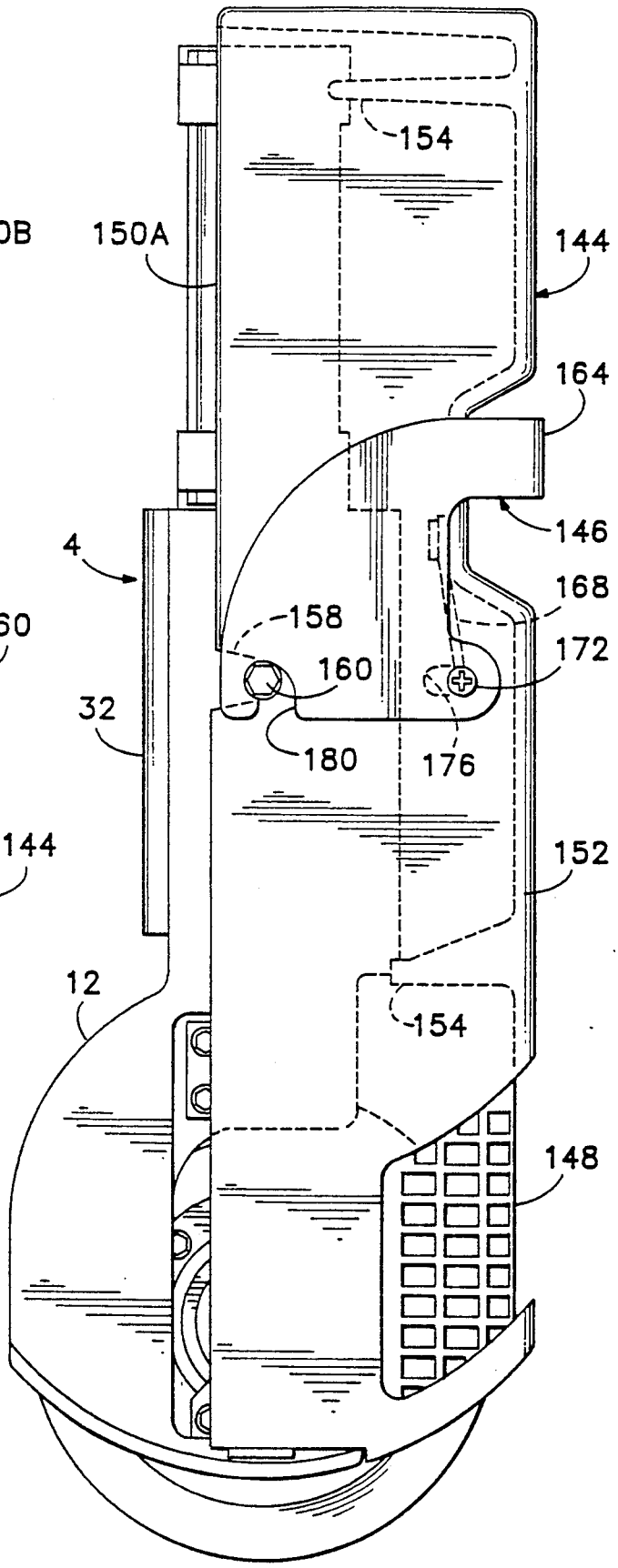

Blade 8 is protected on the downstream side of the upper blade holder by the guard portion 12 of holder body 4. A removable blade cover 144 is provided in order to protect the blade on the upstream side of the upper blade holder. Blade cover 144 is shown in FIGS. 2A and 2B and, together with the guard portion of the upper blade holder, encloses the upper blade completely except in the immediate vicinity of the plane of the material web to be slit. The lowering arms 110 are also covered by the blade cover 144. Blade cover 144 is attached to body 4 of the upper blade holder by means of a quick-release coupling 146. The cover 144 and the body 4 are shaped in such a way as to facilitate the threading of the leading end of the paper web. Blade cover 144 includes protective mesh 148 that enables the upper blade and its support to be viewed. During cutting the blade is in the cutting position shown in solid lines, and at other times in the position shown in dashed lines and therefore more fully protected.

The blade cover is held in position by a quick-release coupling that allows the blade cover to be removed without use of tools. Blade cover 144 is channel shaped in section, having two opposite sides 150A, 150B joined by a base 152. At its interior, the cover has locating members 154 that engage the upper blade holder, and on each side the cover is formed with a notch 158 for receiving opposite respective ends of a pin 160 that extends through the upper blade holder body 4. A handle 164 is connected to the blade cover by means of a plate spring 168 that extends in the space between the two opposite sides of the blade cover. A rod 172 is connected to the plate spring and extends through respective slot-form openings 176 in the two opposite sides of the cover and is pivotally connected to the handle. Thus, the handle is able to pivot about the central axis of the rod, and the rod is able to move transverse to its central axis within the slots. The plate spring biases rod 172 towards the base 152 of the blade cover. Handle 164 has recesses 180 for receiving opposite ends of pin 160. When the cover is applied to the upper blade holder so that the locating members engage the blade holder and the pin 160 is received in the notches 158, the handle can be pivoted in the counterclockwise direction so that the ends of the pin 160 enter recesses 180.

When the handle first engages pin 160, the wedging action of the entry surface of recess 180 against the pin urges the handle in the direction away from the base 152 of the blade cover, against the force provided by the plate spring 168. When the ends of pin 160 are fully received in recesses 180, there is a local minimum in the potential energy of deformation of the plate spring, and accordingly the cover remains securely fastened to the body of the upper blade holder until the handle is pivoted in the clockwise direction by an external force that is sufficient to overcome the bias provided by the plate spring.

It will be appreciated that the toe-in angle of the upper blade can be changed by grinding those surfaces of blocks 20 which engage surfaces 62. When the toe-in angle is changed, the orientation of the vertical plane that contains the central axes of shaft 74 is also changed, and therefore it is necessary to adjust linear guides 112 in order to ensure that the central axes of lowering arms 110 are able to remain vertical.

Above, the invention has been described with reference to one preferred embodiment only. It will be apparent to a person skilled in the art that numerous variations are possible within the scope of the invention as defined in the following patent claims and equivalents thereof. For example, the holder body may be designed so that the guard portion is on the upstream side of the upper blade, in which case the blade support structures extend in the downstream direction and the removable blade cover is provided on the downstream side of the upper blade holder.

I claim:

1. An upper blade holder, for receiving an upper blade for use in combination with a lower blade for shear cutting of materials, comprising an upper blade holder body, shaft means for receiving the upper blade, the shaft means having two opposite ends and defining a blade-receiving location therebetween, and means for supporting the shaft means at said two opposite ends relative to the upper blade holder body, the means for supporting the shaft means including locating means for setting the toe-in angle of the upper blade by engaging the shaft means, and wherein the shaft means comprise a shaft and an end cover, the shaft and the end cover forming an annular-section pneumatic cylinder, an annular-section piston fitted in the pneumatic cylinder and displaceable therein longitudinally of the shaft, and means for mounting the upper blade on the piston, whereby the upper blade can be shifted lengthwise of the shaft.

2. An upper blade holder according to claim 1, wherein the means for mounting the upper blade on the piston comprise a hub assembly, means for securing the upper blade to the hub assembly, and bearing means for supporting the hub assembly for rotation about the annular-section piston.

3. An upper blade holder according to claim 1, wherein the locating means comprise first and second locating blocks for engaging the shaft means at the two opposite ends respectively, and said end cover is formed with a groove extending peripherally thereof and the first locating block is formed with a ridge that is receivable in the groove of said end cover.

4. An upper blade holder according to claim 1, wherein the shaft means further comprise a second end cover and a return spring effective between the second end cover and the piston for urging the piston towards the first-mentioned end cover.

5. An upper blade holder according to claim 4, wherein the locating means comprise first and second locating blocks for engaging the shaft means at said two opposite ends respectively, and wherein one of said end covers is formed with a groove extending peripherally thereof and the first locating block is formed with a ridge that is receivable in the groove of said one end cover.

6. An upper blade holder, for receiving an upper blade for use in combination with a lower blade for shear cutting of materials, comprising an upper blade support including shaft means for receiving the upper blade, the shaft means having two opposite ends, first and second lowering arms connected to the shaft means at its two opposite ends respectively for supporting the shaft means, locating means for setting the toe-in angle of the upper blade by engaging the shaft means, and engagement means connected to the first and second lowering arms for urging the shaft means into engagement with the locating means, and wherein the locating means comprise first and second locating blocks for engaging the shaft means at the two opposite ends respectively, the shaft means comprise a shaft and at least one end cover, and said end cover is formed with a groove extending peripherally thereof and the first locating block is formed with a ridge that is receivable in the groove of said end cover.

7. An upper blade holder according to claim 6, comprising quick-release connector means that connect the shaft means to the first and second lowering arms in releasable fashion, the quick-release connector means having an engaged position in which the shaft means are connected to the lowering arms and a disengaged position in which the shaft means are not connected to the lowering arms.

8. An upper blade holder, for receiving an upper blade for use in combination with a lower blade for shear cutting of materials, comprising an upper blade holder body, an upper blade support including shaft means for receiving the upper blade, the shaft means having two opposite ends, first and second lowering arms connected to the shaft means at its two opposite ends respectively for supporting the shaft means, locating means stationary relative to the upper blade holder body for setting the toe-in angle of the upper blade by engaging the shaft means, and engagement means connected to the first and second lowering arms for displacing the lowering arms relative to the upper blade holder body to bring the shaft means into engagement with the locating means.

9. An upper blade holder, for receiving an upper blade for use in combination with a lower blade for shear cutting of materials, comprising an upper blade support including shaft means for receiving the upper blade, the shaft means comprising a shaft having two opposite ends, a first end cover mounted on the shaft, the shaft and said first end cover forming an annular section pneumatic cylinder, an annular-section piston fitted in the pneumatic cylinder and displaceable therein longitudinally of the shaft, a second end cover, and a return spring acting between the second end cover and the piston for urging the piston towards the first end cover, and wherein the upper blade holder further comprises first and second lowering arms connected to the shaft means at the two opposite ends respectively, and first and second locating blocks engaging the shaft means at the two opposite ends respectively for setting the toe-in angle of the upper blade, and means for mounting the upper blade on the piston, whereby the blade can be shifted lengthwise of the shaft.

10. An upper blade holder according to claim 9, wherein the means for mounting the upper blade on the piston comprise a hub assembly for attachment to the upper blade and bearing means for supporting the hub assembly for rotation about the annular-section piston.

11. An upper blade holder according to claim 9, comprising quick-release connector means that connect the shaft means to the first and second lowering arms in releasable fashion, the quick-release connector means having an engaged position in which the shaft means are connected to the lowering arms and a disengaged position in which the shaft means are not connected to the lowering arms.

12. An upper blade holder according to claim 9, wherein the shaft means are formed with a groove extending peripherally thereof and the first locating block is formed with a ridge that is receivable in said groove.

13. An upper blade holder, for receiving an upper blade for use in combination with a lower blade for shear cutting of materials, comprising:

an upper blade holder body, an upper blade support for receiving the upper blade, means for attaching the upper blade support to the upper blade holder body, a blade cover having first and second abutment portions for engaging the upper blade holder body at two locations that are spaced apart along the upper blade holder body, and a latch member located between the abutment portions for releasably engaging the upper blade holder body between said locations and drawing said abutment portions into engagement with the upper blade holder body, whereby the blade cover is releasably attached to the upper blade holder body.

14. An upper blade holder according to claim 13, wherein the upper blade support includes shaft means having a longitudinal axis and two opposite ends and defining a blade-receiving location between the two opposite ends, the means for attaching the upper blade support to the upper blade holder allow displacement of the upper blade support in directions perpendicular to the longitudinal axis of the shaft means, and the upper blade holder further comprises locating means mounted stationarily on the upper blade holder body for receiving the shaft means and setting the toe-in angle of the upper blade by engaging the shaft means, and means for urging the shaft means into engagement with the locating means.

15. An upper blade holder, for receiving an upper blade for use in combination with a lower blade for shear cutting of materials, comprising:

a shaft having a longitudinal axis and two opposite ends, an end cover fitted on the shaft, the shaft and said end cover forming an annular-section pneumatic cylinder, an annular-section piston fitted in the pneumatic cylinder and displaceable therein longitudinally of the shaft, means for mounting the upper blade on the piston, whereby the upper blade can be shifted lengthwise of the shaft, and means for mounting the shaft to the upper blade holder body.

16. An upper blade holder according to claim 15, wherein the means for mounting the shaft to the upper blade holder body comprise means connecting the shaft to the upper blade holder body so that the shaft is displaceable relative to the upper blade holder body in directions perpendicular to the longitudinal axis of the shaft, locating means mounted stationarily on the upper blade holder body for receiving the shaft and setting the toe-in angle of the upper blade by engaging the shaft, and means for urging the shaft into engagement with the locating means.

17. An upper blade holder, for receiving an upper blade for use in combination with a lower blade for shear cutting of materials, comprising:

an upper blade holder body, an upper blade support including shaft means for receiving the upper blade, the shaft means having a longitudinal axis and two opposite ends and defining a blade-receiving location between the two opposite ends, first and second lowering arms connected to the shaft means at said two opposite ends respectively for supporting the shaft means so that the shaft means are displaceable relative to the upper blade holder body in directions perpendicular to the longitudinal axis of the shaft means, first and second locating blocks mounted stationarily on the upper blade holder body for receiving the shaft means at its two opposite ends respectively and setting the toe-in angle of the upper blade by engaging the shaft means, and means effective between the upper blade holder body and the lowering arms for urging the shaft means into engagement with the locating blocks.

18. An upper blade holder according to claim 17, wherein the means for urging the shaft means into engagement with the locating blocks are double-acting means and are effective to displace the lowering arms selectively either to a position in which the shaft means engage the locating blocks or to a position in which the shaft means are disengaged from the locating blocks.

19. An upper blade holder according to claim 17, comprising quick-release connector means that connect the shaft means to the first and second lowering arms, the quick-release connector means having an engaged position in which the shaft means are connected to the lowering arms and a disengaged position in which the shaft means are not connected to the lowering arms.

* * * * *